US005407079A

United States Patent [19]

Rancourt

[11] Patent Number: 5,407,079

[45] Date of Patent: Apr. 18, 1995

[54] METHOD AND APPARATUS FOR SEPARATING HEAVY PARTICLES FROM PARTICULATE MATERIAL

[76] Inventor: Victor Rancourt, 3652 Gayle St., San Diego, Calif. 92115

[21] Appl. No.: 252,354

[22] Filed: Jun. 1, 1994

[51] Int. Cl.[6] ..... B07B 7/00

[52] U.S. Cl. ..... 209/23; 209/31; 209/142; 209/143; 241/79.2; 241/204; 241/24

[58] Field of Search ..... 209/23, 30, 31, 20, 209/19, 142, 143, 135, 137; 241/79.1, 79.2, 69, 204, 100, 24

[56] References Cited

U.S. PATENT DOCUMENTS

| | | | |
|---|---|---|---|
| 7,828 | 12/1850 | White et al. | 209/142 |
| 3,013,663 | 12/1961 | Vane | 209/135 |
| 3,140,254 | 7/1964 | Katzen | 209/30 |
| 3,861,603 | 1/1975 | Lautzenheiser et al. | 241/100 |
| 5,106,488 | 4/1992 | Jonasson | 209/23 |

*Primary Examiner*—David H. Bollinger

*Assistant Examiner*—Lisa A. Douglas

*Attorney, Agent, or Firm*—John R. Duncan; Frank D. Gilliam

[57] ABSTRACT

A dry washer for separating small high density particles such as gold from a mixture of high and low density material. A rotatable impeller in a cylindrical chamber draws in air and mixed particles, such as sand, and fractures the larger particles. The mixture of air and particles passes to a helical conduit having a perforated partition spaced from the outer wall so that high density particles pass through the wall under centrifugal forces. The particles are passed from the helical conduit to an inclined upper trough including an air permeable floor and riffles or the like to retain the high density particles. Air flow from the helical conduit is directed to a lower trough below the trough. A damper at the end of the lower trough causes air to pass through the air permeable floor and blow away fine low density particles. Dust and air from the trough assembly is passed to an elongated cover to collect the fine, low density, particles.

20 Claims, 3 Drawing Sheets

METHOD AND APPARATUS FOR SEPARATING HEAVY PARTICLES FROM PARTICULATE MATERIAL

BACKGROUND OF THE INVENTION

This invention relates in general to particle separation by density and, more particularly to a dry washer which crushes ore and separates high density particles, such as gold, from a mixture of natural fragments and crushed ore.

Dry washers of several types have long been used in mining gold in desert areas where there is not sufficient water for water sluices and the like. Typical dry washers have a series of inclined troughs and some means for moving dry particulate ore material along the troughs while retaining heavy particles such as gold and magnetite. The final trough generally has a means for trapping the heavy particles, such as Batis cloth with small cross pieces forming riffles in contact with the cloth. Small, high density particles are trapped in the cloth and behind the riffles while larger, low density particles bounce along the trough to an exit. Often, separation is enhanced by mechanisms for vibrating the troughs or for blowing air upwardly through the cloth to blow away small low density particles.

After a suitable quantity of particulate material has been passed through the dry washer, the riffles and cloth are removed and the concentrated fine, high density, material thereon is collected for further processing. Typically, with a small operation, the concentrate can be placed in a conventional gold pan with a small amount of water and panned out to separate gold flakes from particles of other heavy materials such as magnetite ("black sand"). Alternatively, mercury may be mixed with the concentrate to amalgamate with gold and the mercury later removed by distillation or the like. Amalgamation results in a greater recovery of very small particles of "flour" gold.

While conventional dry washers are useful to the hobbyist gold seeker, they are inefficient in that they recover only a relatively small percentage of the gold or other desired high density particles. They also require considerably manual labor in shoveling particulate material such as sand and small gravel into the uppermost trough. A large amount of fine dust is produced and blows around the dry washer, making operating the dry washer uncomfortable. The more efficient dry washers tend to be quite large and heavy, using several sequential troughs and a gasoline engine driven blower to separate light fines from the material. Further, these dry washers are ineffective where the particulate material contains fairly large gravel, since they cannot break up the large particles which may have cracks and crevices containing gold flakes.

A great many other devices have been developed for separating particulate material by size or density for a variety of industrial purposes. For example, vortex chambers such as described by Bielefeldt in U.S. Pat. No. 4,801,310 in which a gas or liquid stream containing particles is rotated rapidly, driving heavy particles to the outside of the chamber by centrifugal force for later recovery are effective with many materials. However, because of their large sizes, complexity, high power requirements and cost such vortex chambers are not useful for small scale gold recovery and the like, especially in isolated areas far from electric power lines.

A number of devices have been developed for pulverizing large particles in a moving gas stream, then collecting the resulting small particles. Typical of these are the fluid current comminuter described by Smith in U.S. Pat. No. 2,624,517 and the moving fluid stream pulverizer of Pipperoux et al. as described in U.S. Pat. No. 2,628,786. Other comminuters use rotating hammers for crushing large particles such as described by Okada et al. in U.S. Pat. No. 3,899,139 and Shepherd in U.S. Pat. No. 3,367,582. While effective, these are very large devices requiring considerable electrical power.

Once large particles have been crushed and high density particles have been concentrated from an ore deposit or the like, gold may be separated by amalgamation with mercury. A number of different amalgamation devices have been designed, such as the amalgamator described by Black in U.S. Pat. No. 681,034. After any gold in a mixture of sand and the like has been amalgamated, the mercury can be separated from the sand with an apparatus such as is described by Wehrel et al. in U.S. Pat. No. 265,898. These devices also tend to be large, cumbersome and require a power source not available in remote areas.

Thus, there is a continuing need for an improved apparatus and method for separating high density particulate material, such as gold, from ore consisting of large and small particles such as sand and rocks. Problems of the prior devices include low recovery efficiency, large size and high power requirements, the inability to effectively crush rocks and the like on a rapid, low power requirement basis, the need for manually shoveling ore into the device and the resulting large clouds of dust around the device. Further, there is a need for improved concentrate recovery and treatment means, including simple and light weight mercury amalgamation means.

SUMMARY OF THE INVENTION

The above-noted problems, and others, are overcome by the method and apparatus of this invention, which basically comprises an impeller positioned in a chamber for rotation at high speed by a small engine powered by gasoline, electricity or the like, with an entrance on or near the axis of rotation for receiving particulate material to be separated according to particle density and an exit adjacent to the periphery of the impeller. The impeller in conjunction with an adjacent chamber wall crushes larger particles. A helical conduit receives particulate material from the chamber, performs an initial separation according to density, and delivers the material to the first of one or more sloping troughs for further concentration of high density particles and disposal of low density particles.

The rotation of the impeller causes a low pressure region to exist at the impeller axis and a high pressure region at the impeller periphery. Ore particles will be drawn through a hose connected at one end to the chamber entrance when the other end is brought into contact with a deposit of ore particles. The impeller blades forcefully drive particles against a wall of the chamber adjacent to the impeller periphery, causing at least some of them to fracture. The high pressure air at the impeller periphery will further force the air and entrained particles out the exit and through the helical conduit. Centrifugal forces will drive the particles outwardly toward the outer wall of the conduit helix as they pass through the conduit.

A perforated sheet spaced from the outer wall of the helical conduit, preferably about 0.75 to 1 inch, will permit particles to pass through and travel around the helix between the partition and outer wall.

At the end of the conduit a baffle directs the small particles that traveled between the partition and the outer wall into an inclined trough having a perforated floor covered with a layer of material that retains very small, high density particles while allowing lower density particles to pass along the trough. Typically, a coarse, gas-permeable ,cloth such as Batis cloth may be used with a riffle sheet holding the cloth against the perforated floor. The riffles may be in the form of an expanded metal mesh, a removable lattice having a peripheral frame and cross bars forming low ridges across the trough or any other suitable means.

The primary air stream is directed by the baffle into a duct just under the perforated floor of the trough. As air passes through the duct a large proportion of the air flow passes upwardly through the material on the perforated trough floor, blowing light dust-like particles up and out of the trough. A variable air flow retarding damper is provided at the exit end of the duct, so that the relative proportions of the air flow passing up through the perforated trough floor and passing directly out the duct exit can be controlled.

Larger low density particles passing out the duct exit will form an elongated pile at the exit that is removed from time to time. Preferably, an elongated covering extends loosely for a distance beyond the trough exit end so that light, dust-like, particles will settle out of the air stream or, at least, be directed into the atmosphere some distance from the dry washer assembly, to avoid the discomfort of dust swirling around the unit. Typically, this covering could be in the form of a cloth arch or tube supported on fiberglass or metal arches.

For ease of transport, the helical conduit is made easily removable from the circular chamber and the trough assembly is easily removable from the helical conduit, so that each component is reasonably light in weight for easy transport to remote locations.

From time to time, the apparatus is shut down and the material on the perforated trough floor is carefully removed and particulate material thereon is placed in a suitable container. Later, the material may be panned out in a conventional manner, amalgamated with mercury, etc. to recover gold and other desired high density materials.

Accordingly, it is an object of this invention to provide a method and apparatus for separating and concentrating small high density particles, such as gold, from a particulate material mixture which is highly efficient while being lightweight and easily portable. Another object is to provide a vacuum suction means for feeding mixed particulate material to a particle separator. A further object is to reduce the airborne dust produced by a particle separator. Still another object is to provide a method and apparatus for crushing larger particles just prior to separation. Yet another object is to use a high velocity air stream and centrifugal forces to convey and separate high density particles from a mixture of particles.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
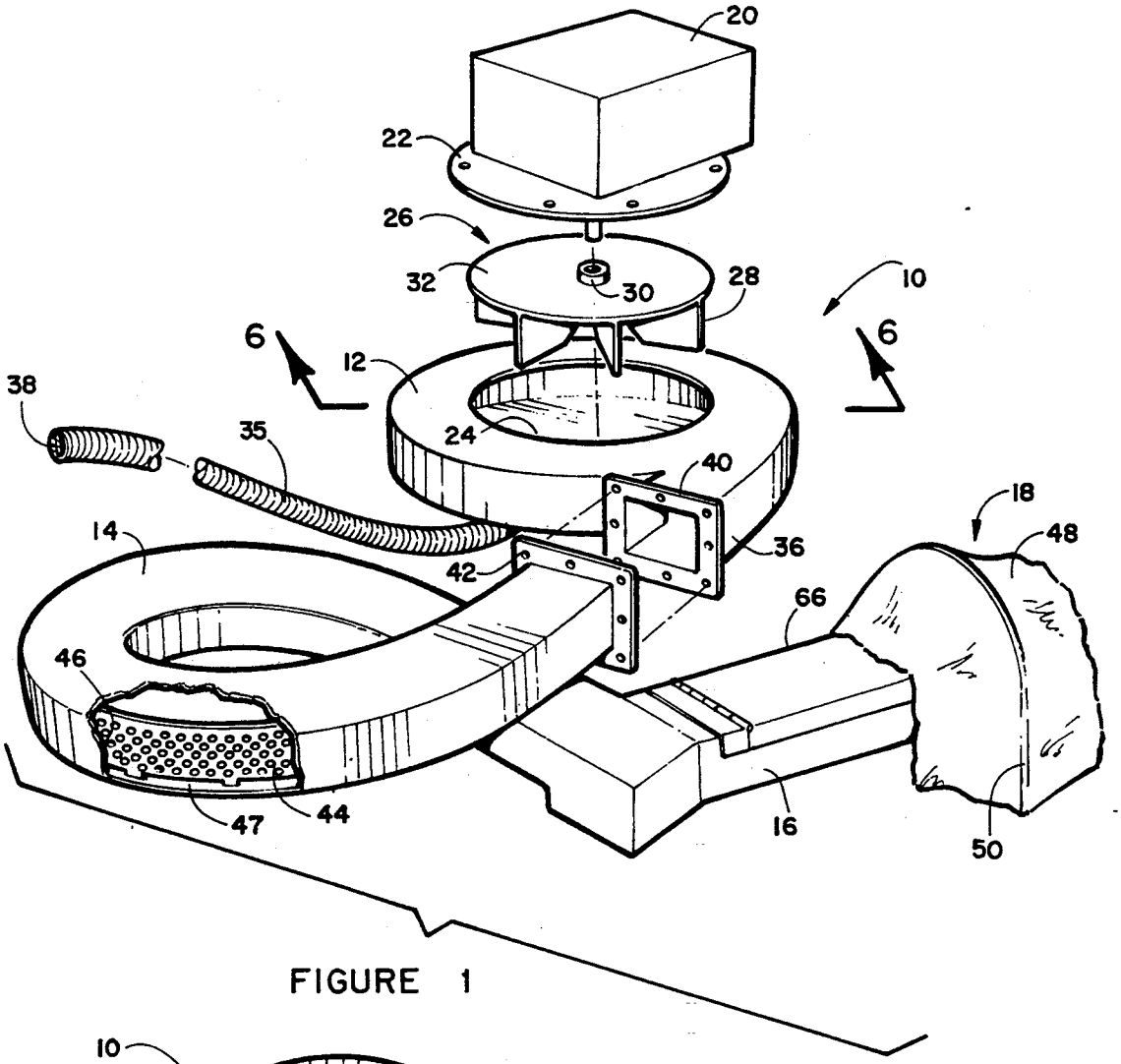
FIG. 1 is a schematic, exploded, perspective view of the dry washer of this invention.
Figure 2:
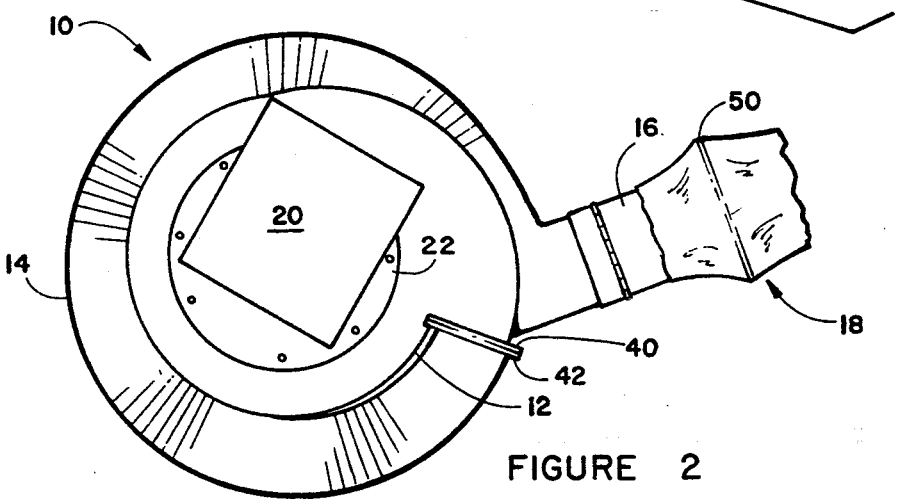
FIG. 2 is a plan view of a second embodiment of the dry washer.

Referring to FIGS. 1 and 2, there is seen a dry washer 10 for separating small, high density, particles from a mixture of particles of different sizes and densities. Basically, dry washer 10 includes a circular chamber 12, a helical conduit 14, a trough assembly 16 and a cover 18 for the exiting air stream and light particles.

A drive means 20 is mounted on a cover 22 which closes an opening 24. An impeller 26 is mounted to drive means 20 for rotation thereby. Any suitable drive means may be used. In general, a small gasoline fueled engine such as a Quantum from Briggs & Stratton is preferred. The size of the engine will depend on the size of the entire assembly. In general, gasoline engines of from about 3 to 5 horsepower are effective. In some cases, where electrical power is available, an electric motor may be used for drive means 20.

Impeller 26 may have any suitable number of straight or curved blades 28 extending outwardly from a hub 30 adapted to be secured to the output shaft of drive means 20. For maximum strength and rigidity, it is preferred that blades 28 be secured to a circular baseplate 32. The ends of blades 28 are preferably spaced from the inside surface of chamber 12 from about 0.5 to 1.5 inches. Large particles, typically up to about 0.5 inch diameter are fragmented by impact against blades 28 and against the inner wall of the chamber.

Figure 6:
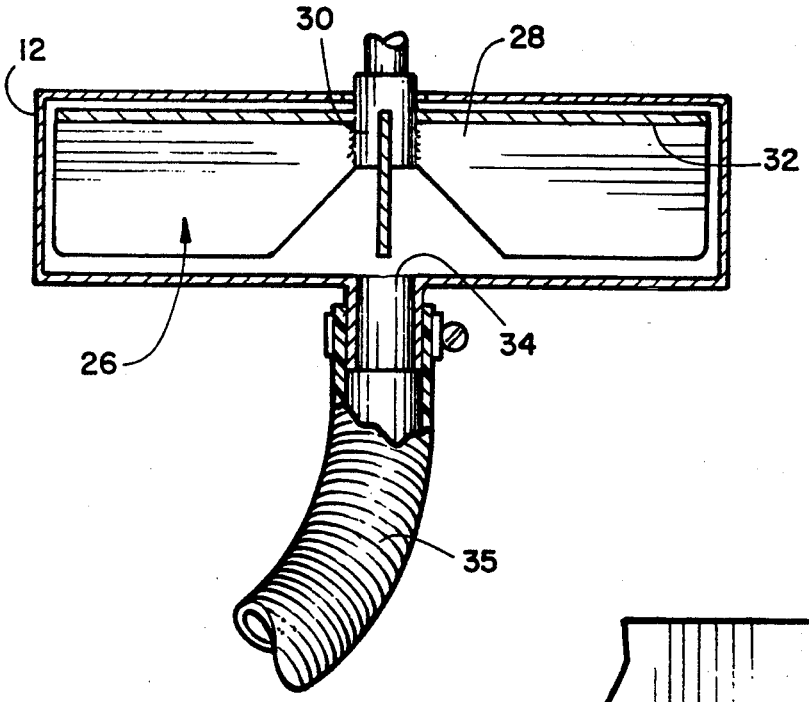
FIG. 6 is a vertical section taken on line 6—6 in FIG. 1.

Chamber 12 is preferably cylindrical in configuration, with the chamber closed except for inlet 34 connected to hose 35 (as seen in FIG. 6) at or near the bottom center of chamber 12 and a tangential exit 36. Chamber 12 may be mounted on any suitable support (not shown), such as an open framework of bolted or welded angle iron shaped to hold the dry washer or a plurality of removable legs.

Chamber exit 36 includes a flange 40 adapted to be bolted to a flange 42 at the inlet end of helical conduit 14. These flanges make assembly and disassembly of dry washer 10 into smaller, easily transported components more convenient. Bolts with wingnuts may be used for ease of assembly and disassembly. While not ordinarily necessary, a suitable gasket may be used between flanges 40 and 42.

Rotation of impeller 26 at high speed, typically from about 1800 to 2500 rpm will create a low pressure region around the the impeller axis of rotation and a high pressure region in the region of the ends of blades 28. This will draw air in through inlet 34 and hose 35 into chamber 12 and force the air outwardly through exit 36.

A grid 38 is preferably included across the inlet end of hose 35 to limit the size of particles that can be admitted, to avoid clogging in the hose. Typically grid 38 will have a spacing of up to about 0.5 inch. Most of the material entering hose 35 will be sand-like. Larger particles, in particular cracked large particles, will be impacted by blades 28 and will be thrown against the inside surface of the side wall of chamber 12, fracturing most of those large particles. Centrifugal force in the rotating air mass in chamber 12 will concentrate particles along the chamber outside wall with highest density particles along the wall surface.

Helical conduit 14 preferably has a generally rectangular cross section although other shapes could be used, if desired. As seen in FIG. 1, the helix preferably is positioned adjacent to chamber 12 for ease of assembly, disassembly and use. If desired, the helix may be arranged concentric with the axis of chamber 12 and, in part, lie below chamber 12 as illustrated in FIG. 2 for compactness in operation.

while helical conduit 14 may extend any suitable distance around the helix axis and may have any suitable diameter. For the optimum combination of separation efficiency and light weight, the conduit will extend around from about 260 to 360 degrees relative to the conduit axis and will have a diameter of from about 12 to 24 inches.

A perforated partition 44 extends along the outer wall of helical conduit 14, approximately parallel to and spaced from the outer conduit wall to form a narrow duct 46. For best results, the perforations have diameters of from about 0.25 to 0.5 inch and cover from about 25 to 47 per cent of the partition surface. In addition, elongated slots 47 are provided in partition 44 along the floor of the conduit to aid in movement of particles into the space between partition 44 and the outer conduit wall. Slots 47 preferably have lengths of from about 6 to 12 inches and heights of up to about 0.5 inch. As the air stream passes from chamber 12 into conduit 14, the high density, small, particles will tend to pass along duct 46 (as shown in detail in FIGS. 3–5) with most of the air stream and larger, lower density particles in the main portion of conduit 14. As the air stream moves along conduit 14, centrifugal forces will continue to force particles outwardly, passing through perforations in partition 44 into duct 46. Gradually, substantially all particles will be moving in duct 46.

The exit end of helical conduit 14 is releasably connected to the entrance end of trough assembly 16. The air stream passes through trough assembly 16 and exits into cover 18 after completion of separation of heavy particles, as detailed below.

Figure 3:
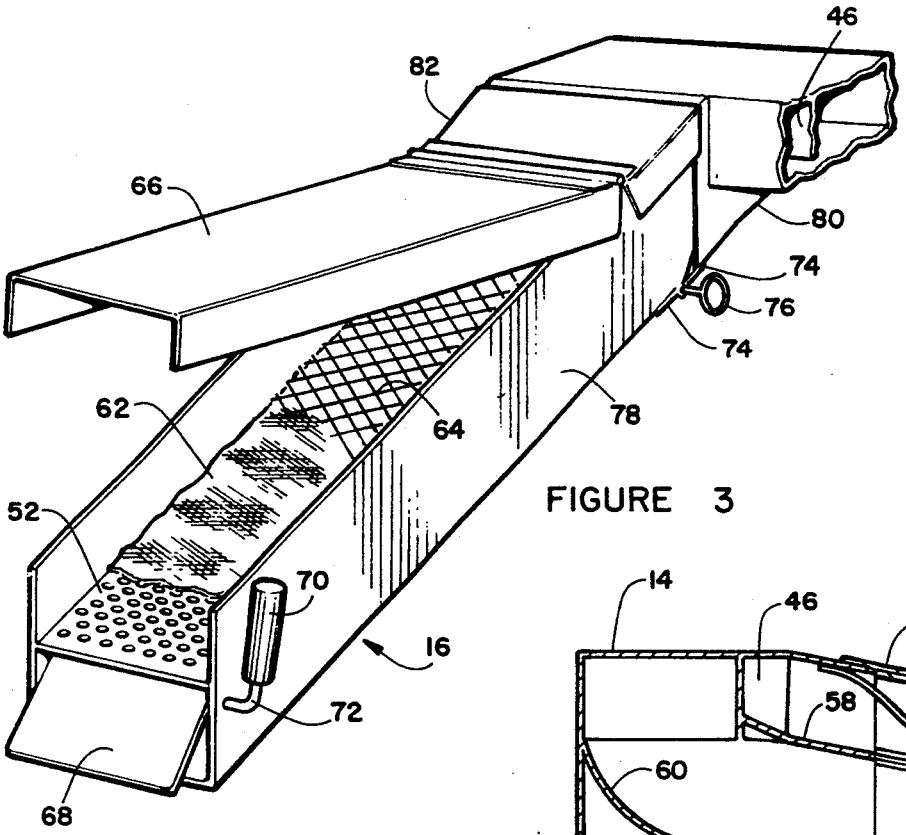
FIG. 3 is a schematic perspective view of the output trough portion of the dry washer.
Figure 4:
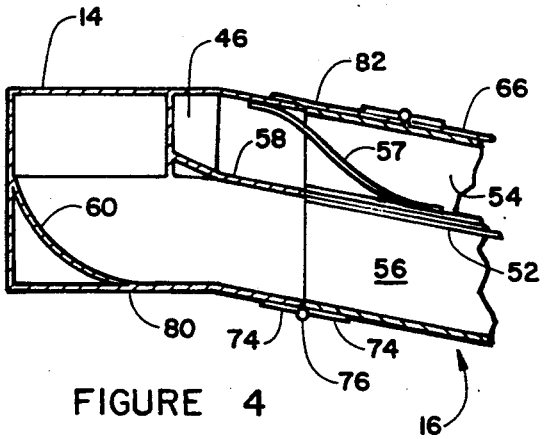
FIG. 4 is a detail plan view, partially cut-away, of the connection between a helical chamber and the trough portion of the dry washer.
Figure 5:
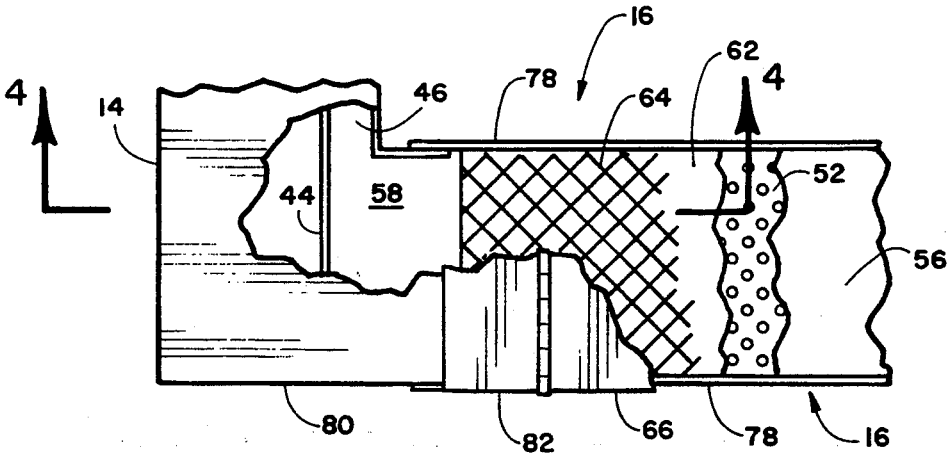
FIG. 5 is vertical section view taken on line 5—5 in FIG. 4.

Details of the exit region of helical conduit 14 and of trough assembly 16 are provided in FIGS. 3–7. Trough assembly 16 includes a channel having an open-topped U-shaped cross section, with a perforated divider 52 approximately parallel with the bottom of the channel dividing the channel into an upper trough portion 54 and a lower trough portion 56. A crosswise panel 58 (as best seen in FIG. 5), connects between partition 44 and divider 52 to direct air flow and entrained particles from duct 46 into upper trough 54. A guide 60 directs the flow of air from the balance of helical conduit 14 and into lower trough 56. Thus, the major portion of the air flow passes into lower trough 56.

A flexible rubber or plastic flap 57 is preferably attached to the upper surface of conduit outlet 80 as seen in FIG. 4. The flap extends over the entrance of trough assembly 16 and aids in directing particles entrained in the air flow down towards the surface of mesh 64 so that all particles contact the retaining sheets and are not carried directly out of the trough assembly with the air stream. Typically, flap 57 is formed from about 0.05 to 0.1 inch thick rubber sheeting and may be secured to the upper outlet surface by an adhesive, pop rivets or the like.

Any suitable means for trapping and retaining high density particles may be used on the upper surface of perforated divider 52. Typically, a sheet of appropriate air permeable cloth 62, such as Batis cloth, and a riffle forming and cloth retaining material such as expanded metal mesh 64 may be used. If desired, other riffle forming materials, such as a plurality of low metal or plastic cross pieces fastened to a removable frame may be used. Or, a mercury coated copper plate could be used for at least a portion of the bottom of upper trough 54 to trap and amalgamate very fine "flour" gold.

A hinged cover 66 is provided to close the top of trough assembly 16 during operation of the dry washer and to allow access to upper trough 54 for removal of cloth 62 and mesh 64 with any high density material trapped thereon.

Perforations in perforated divider 52 permit air to flow upwardly through cloth 62 to blow away any very light, low density, dust particles that may become trapped in cloth 62 and/or mesh 64. A damper 68 is provided at the outlet of lower trough 56 to put back pressure on the air stream therethrough and force air to pass upwardly through cloth 62. A weight 70 on an arm 72 connected to damper 68 can be adjusted, to vary the restricting force of damper 68 as detailed below.

The side walls 78 of trough assembly 16 telescope over the sides of helical conduit outlet section 80. A forward cover portion 82 hinged to cover 66 and extends over the sides of the trough and slightly over the top of conduit outlet section 80. cover 66 and cover portion 82 are not fastened to trough assembly 16 but merely rest thereon and are retained by the hinges and the weight of the cover. Hinge members 74 of the sort held together by a hinge pin of the type used in conventional door hinges are secured to the abutting bottom edges of trough assembly 16 and conduit 14. An elongated pin 76 extends through hinge members 74 to hold the parts together during use. Pulling pin 76 from the hinge members and lifting trough assembly 16 will disengage the trough assembly from helical conduit 14 for transportation, storage, etc. In use, trough assembly is supported on any suitable support (not shown) such as an angle iron framework, sandbags, adjustable legs or the like in a manner permitting the height of the exit end to be adjacent to adjust the angle of the trough for optimum performance. As the angle of the trough is adjusted, cover portion 82 and side walls 78 can slide over the conduit outlet 80 to maintain a sealing relationship. If desired, though generally not necessary, sealing strips such as felt may be applied to the sliding surfaces.

FIG. 6 shows the preferred location of the connection of hose 35 to inlet 34 substantially coaxial with the axis of rotation of impeller 26. If desired, inlet 34 could be located off center or adjacent to drive means 20 in the top of chamber 12. While each of blades 28 could be rectangular and extend in to a longer hub 30, the angled blades 28 shown are preferred with the axial inlet location.

Cover 18 includes a flexible cover material 48 such as cloth or plastic sheet material supported by a plurality of spaced arches 50 secured to the sheet material. Arches 50 may be formed from any suitable material, such as metal or fiberglass rods preformed to the shape shown. The arches are threaded through tubes sewn into cover 48 or small spaced loops secured to the cover. Long straight rods 51 are threaded into hems or loops along the edges of cover 48 that contact the ground. Loose material extends over trough assembly 16 at the entrance end of cover 18 to flexibly contact the exterior of the trough assembly.

Figure 7:
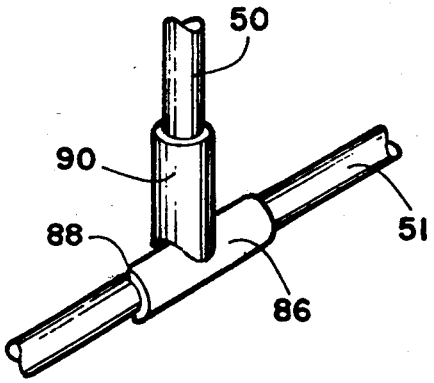
FIG. 7 is a detail view, partially cut-away, showing the cover support arrangement.

Arches 50 are secured to long rods 51 and maintained in an upright position by fittings 86 as shown in the detail view of FIG. 7. Each fitting 86 includes a half tube 88 sized to fit along a long rod 51 at the location of an arch rod 50. A tube 90, sized to receive the end of an arch rod 50 is secured to half tube 88 by brazing or the like. An end of an arch rod is inserted into a tube 90 and the half tube is secured to the long rod by means of any suitable small clamp, such as a small C-clamp or an Acco clamp of the sort used in offices for securing plural sheets of paper together. While the ends of arch rods 50 generally will be retained sufficiently in tubes 90 by a combination of gravity and friction, set screws may be used to further lock arches 50 to tubes 90.

While cover 18 may have any suitable diameter and length, it preferably is configured to allow most of the light weight material exiting trough assembly 16 to settle out as an elongated pile and direct any remaining dust out at a distance from the dry washer 10. Preferably, cover 18 has a height of from about 8 to 12 inches and a length of from about 8 to 12 feet.

Figure 8:
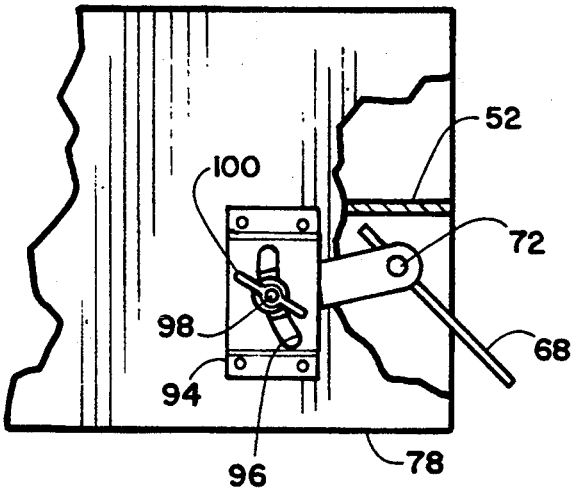
FIG. 8 is a detail view showing the trough assembly damper adjustment mechanism.

FIG. 8 shows the preferred arrangement for adjusting the position of damper 68 and, accordingly, the proportion of the air flow directed through perforations 52, as shown in FIG. 3. Damper 68 is fastened to an arm 72 that extends through both side walls 78 of trough assembly 16. One end of arm 72 is bent and carries a handle 70. On the opposite side wall, a bar 92 is secured to the end of arm 72 and extends back along the sidewall surface. A bracket 94 is fastened to sidewall 78 in a spaced relationship with bar 92 between the bracket 94 and the sidewall. An arcuate slot 96 in bracket 94 cooperates with a stud 98 extending through the slot and a wingnut 100 threaded onto stud 98. When wingnut 100 is loosened, the angle of damper 68 can be adjusted with handle 70. The damper is then locked in place by tightening wingnut 100.

While certain preferred materials, dimensions and arrangements have been detailed in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

I claim:

1. A dry washer for separating higher density particles from lower density particles which comprises:

a rotatable impeller means, having an axis of rotation, for drawing air and entrained particulate material into said impeller in a first region adjacent to said impeller axis of rotation and for expelling air and entrained particulate material at a second region spaced from said impeller axis of rotation;

drive means for rotating said impeller;

a chamber surrounding said impeller, said chamber having top surface;

an inlet opening communicating with said first region for admitting air and particulate material into said chamber;

a chamber wall cooperating with said impeller to fracture at least some of the admitted particles;

an outlet opening communicating with said second region for permitting air and expelled particulate material to pass from said chamber;

a helical conduit having upper, lower, inner and outer walls, and an entrance and an exit, for receiving air and particulate material from said chamber;

at least one perforated partition along said helical conduit spaced from an outer wall of said helical conduit so that small high density particles can pass through said partition in response to gravitational and centrifugal forces;

a trough assembly for receiving said particulate material and air from said helical conduit;

said trough assembly including:

means for retaining the higher density particles and discharging lower density particles;

an upper trough and a lower trough separated from said upper trough by a perforated sheet forming a floor of said upper trough;

means for directing small particles and part of air flow from said conduit into an entrance end of said upper trough; and means for directing part of air flow from said conduit and any remaining large particles into an entrance end of said lower trough to an opposite exit end.

2. The dry washer according to claim 1 further including a duct connected between said perforated partition and said outer conduit wall for receiving particles therefrom and directing particles from said space into said upper trough.

3. The dry washer according to claim 1 further including a flexible flap fastened within said upper trough and extending a selected distance along said upper trough to direct particles entering said upper trough along said floor of said upper trough and elongated slots along said perforated partition adjacent to said floor of said upper trough.

4. The dry washer according to claim 1 further including an outlet connected to an inner space between said perforated partition and said inner conduit wall and directing air flow and any remaining particles into said lower trough.

5. The dry washer according to claim 1 further including sheet means on said perforated sheet for capturing the relatively highest density particles and riffle means for releasably holding said sheet means against said perforated plate and further capturing higher density particles.

6. The dry washer according to claim 5 further including variable flow restricting means at the exit from said lower trough to force at least some of the air flow through said lower trough upwardly through said perforated sheet to blow fine, lower density particles from said sheet and out the upper trough exit.

7. The dry washer according to claim 6 where said variable flow restricting means includes a damper at the lower trough exit, a handle for moving said damper to a selected position and a locking means for locking said damper in a selected position.

8. The dry washer according to claim 1 further including a removable cover for said upper trough.

9. The dry washer according to claim 1 wherein said trough assembly includes a pin means for locking a lower entrance edge of said trough assembly to a helical conduit exit edge, with sides of said trough assembly entrance telescope over sides of said helical conduit exit and a cover means over said upper trough extending over said upper trough at said conduit exit so that an angle of said trough assembly relative to horizontal can be changed without significant air leakage at said conduit exit, trough assembly entrance, interface.

10. The dry washer according to claim 1 wherein said helical conduit includes an entrance releasably secured to the exit from said chamber and said helical conduit is positioned adjacent to said chamber.

11. The dry washer according to claim 1 wherein said helical conduit includes an entrance releasably secured to the exit from said chamber and said helical conduit is concentric with said chamber.

12. The dry washer according to claim 1 further including a flexible hose extending from said chamber inlet having a length sufficient to reach particulate material to be pulled into said chamber and a grid across the entrance of said hose to limit the diameter of particles being pulled in.

13. The dry washer according to claim 1 further including a cover overlapping the exit of said trough assembly and extending away therefrom a selected distance.

14. The dry washer according to claim 13 wherein said cover is made from flexible sheet material and includes a plurality of spaced arches and means for maintaining said arches upright so that said cover forms an elongated tube.

15. The dry washer according to claim 14 wherein said means for maintaining said arches upright includes elongated rods secured to said cover along edges of said open bottom and clips securing said rods to said arches.

16. The dry washer according to claim 15 wherein said rods extend through first holding means along the edges of said open bottom of said cover and said arches extend through second holding means, said first and second holding means selected from the group consisting of loops or tubes secured to said cover.

17. The dry washer according to claim 15 wherein said drive means is mounted on said top surface of said chamber, said impeller includes a plurality of blades extending outwardly from a hub and secured to a plate adjacent to an upper region of said chamber, said blades lying coplanar with said axis of rotation.

18. The dry washer according to claim 17 wherein said inlet is installed on the surface opposite said motor substantially coaxial with the axis of impeller rotation and at least a portion of said blades adjacent to said inlet are cut away.

19. A method for separating high density particles from a mixture of particles of different densities which comprises the steps of:

moving a stream of air and entrained particles by suction into a chamber;

forcefully directing said air and entrained particles against a wall of said chamber to fracture at least some particles;

causing said air and entrained particles to exit said chamber and move along a helical path;

separating small high density particles from the mass of particles by centrifugal force;

moving said particles and part of said air flow along a first trough for capture by elements on a perforated floor of said first trough;

directing part of said air flow through a second trough adjacent to said perforated floor; and restricting air flow exiting said second trough to cause at least part of said air flow to pass through said perforated sheet and blow lower density, fine, particles from said elements.

20. The method according to claim 19 including the further step of trapping a substantially proportion of the air and entrained lower density particles exiting said troughs.

* * * * *